US006806839B2

(12) United States Patent
Lo

(10) Patent No.: US 6,806,839 B2
(45) Date of Patent: Oct. 19, 2004

(54) WIDE BANDWIDTH FLAT PANEL ANTENNA ARRAY

(75) Inventor: Zane Lo, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 1 day.

(21) Appl. No.: 10/334,316

(22) Filed: Dec. 31, 2002

(65) Prior Publication Data

US 2004/0104859 A1 Jun. 3, 2004

Related U.S. Application Data

(60) Provisional application No. 60/430,541, filed on Dec. 2, 2002.

(51) Int. Cl.[7] ..... H01Q 21/00

(52) U.S. Cl. ..... 343/725; 343/767; 343/770; 343/789

(58) Field of Search ..... 343/789, 725, 343/727, 767, 770, 769, 795, 797

(56) References Cited

U.S. PATENT DOCUMENTS 4,839,663 A * 6/1989 Kurtz ..... 343/771
5,243,290 A * 9/1993 Safinya et al. ..... 324/338
5,334,941 A * 8/1994 King ..... 324/637
5,592,185 A * 1/1997 Itabashi et al. ..... 343/794
6,031,503 A * 2/2000 Preiss et al. ..... 343/770
6,373,349 B2 * 4/2002 Gilbert ..... 333/126
6,424,309 B1 * 7/2002 Johnston et al. ..... 343/767
6,452,462 B2 9/2002 Lo

* cited by examiner

*Primary Examiner*—Tho Phan
(74) *Attorney, Agent, or Firm*—Daniel J. Long

(57) ABSTRACT

A cavity-backed wideband slimline flat panel antenna array for providing a steerable beam includes an array of slot antennas, each of which fed by its own individual dipole radiator, with the wide bandwidth being due to the matching impedances of the slot antenna and dipole radiator across the entire frequency band. In one embodiment, an upstanding printed circuit balun feed is connected to each dipole. The dipole elements are located to either side of a slot, and are arrayed on the underneath side of a dielectric layer under the substrate into which the slots are formed, with the dipole elements directly fed by individual upstanding printed circuit baluns which are arrayed beneath the individual slots antennas. The use of the dipole elements, in addition to providing a wider operational bandwidth, also permits feeding each of the slots without having to use striplines which would have to cross each other and therefore not work. A wide bandwidth steerable flat panel array utilizing the dipole fed slot antennas may be mounted on the deck house or other flat structural component of a vessel so as to perform a "smart skin" function in which the antenna not only functions as a radiating element, but also as a structural part of the vessel itself. In commercial applications, the flat panel array may be incorporated into the wall of a building such that point-to-point communications between buildings may be accomplished through an antenna which is also a structural part of the building. Note that the beams from the antenna are aimable by appropriately phasing the array to point at a receiving antenna on an adjacent building.

7 Claims, 9 Drawing Sheets

WIDE BANDWIDTH FLAT PANEL ANTENNA ARRAY

CROSS REFERENCE TO RELATED APPLICATION

This application claims rights under U.S. Provisional Application Ser. No. 60/430,541, filed Dec. 2, 2002.

FIELD OF INVENTION

This invention relates to antennas and more particularly to a wide bandwidth antenna array manufacturable in a slim-line flat pack configuration.

BACKGROUND OF THE INVENTION

Dish type microwave antennas have for some time been located on ships where they are vulnerable to attack as well as damage in ocean going conditions. As a result, there has been an effort to provide so-called "smart skin" antennas in which the antennas are configured in a flat panel array and become part of the structure in which they are embedded, namely for instance a wall of a deck house.

In order to provide a flat panel antenna a standard slot antenna array is fed with a balanced line feed directly connected to opposed sides of the slot. A 180-degree hybrid is used to convert an unbalanced line such as a coaxial cable to a balanced feed. One of the problems with such a direct coupled balanced line feed for a slot antenna is the relatively narrow bandwidth of the resulting antenna. In the usual instance the percent bandwidth is approximately 10%, such that for an antenna tuned to 100 MHz, the operating frequency range would be 100 MHz plus or minus 5 MHz.

In an effort to improve on the operating frequency range of slot antennas, stripline feeds have been devised in which a conductive strip is mounted transverse to the slat on the underneath side of a dielectric layer on top of which a slotted conductive layer is patterned, with the stripline either terminated in a resistive load or in an approximately ¼λ long radial stub.

While the bandwidth of such a stripline fed slot antenna is indeed better than the standard antenna, its 25% bandwidth still does not provide the type of frequency coverage that one would like. For instance with a 25% bandwidth for a 100 MHz center frequency, the frequency range of the antenna is 100 MHz plus or minus 12.5 MHz.

More importantly, when utilizing stripline to feed slot antennas, it is only with difficulty that one can obtain an array of slot antennas due to the fact that the striplines must, of necessity, cross each other, making feeding of these antennas virtually impossible. Thus, even though there is a theoretic increase in the bandwidth of slot antennas fed with terminated striplines, arrays of these slotted antennas have proved to be elusive from the point of view of manufacture.

SUMMARY OF THE INVENTION

In order to solve the problem of providing a single wide bandwidth flat panel cavity-backed antenna array, in the subject invention each of the slots of the array is fed by a dipole radiator which, in one embodiment consists of a pair of tear drop shaped pads underneath an associated slot, with the pads being spaced from the slot by a dielectric layer. In a preferred embodiment, the tear drop shaped pads are positioned to either side of the slot antenna at the mid point of the slot. Off-center feeds are also contemplated and are within the scope of the subject invention. Thus, rather than traversing the slot with a stripline, only a limited area pad need be provided underneath a slot at its mid-point to be able to drive the antenna.

In one embodiment, the dipole elements are fed by an upstanding printed circuit balun such as that described in U.S. Pat. No. 6,452,462 issued to Zane Lo on Sep. 17, 2002 and assigned to the assignee hereof, with an upstanding printed circuit balun underneath each dipole, there need be no crossed striplines. This makes arraying the slot antennas possible. Note that there are other types of baluns usable to feed each dipole, and the subject invention is not limited to the particular balun used.

What makes the dipole driven slot antenna attractive as a wide bandwidth antenna is the fact that the slot antenna is driven by another antenna, namely the dipole radiator, rather than by a capacitative coupling or a balanced line hard connection.

The dipole radiator can be configured such that its impedance characteristics match the impedance characteristics of the slot antenna such that the two impedance characteristics match from the low frequency end of the antenna to the high frequency end. Thus, rather than having an impedance match which only matches at for instance to a 50 ohm for coaxial cable and thus results in a narrowband antenna, utilization of the dipole radiator with its matching impedance results extremely wideband antenna. This being the case, in one embodiment the present bandwidth of the combined dipole radiator fed slot antenna is in the 70% range, meaning that for a 100 MHz center frequency, for example, the frequency range of the antenna is 100 MHz plus or minus 35 MHz.

Additionally, because the dipole feed is of such limited territorial extent, the array may be configured such that a first set of low frequency antenna slots can be interspersed between another array of high frequency slots utilizing the same real estate and the same substrate such that the slots are formed in the same conductive ground plane.

It is therefore possible, for example, to provide an antenna array operating between 100 and 200 MHz, with another array operating between 200 and 400 MHz. Because there are no overlapping of frequencies, there is only negligible cross talk between the two antenna arrays. The result is a 100–400 MHz array in the example mentioned above, with the two arrays being co-planar and co-extensive, although interleaved. Note that 100–400 MHz is just an example. The operating frequency is actually scalable to all other frequency bandwidths. For example, one can devise an array having a frequency range from 500 to 2000 MHz, or 1 GHz to 4 GHz.

Utilizing the printed circuit baluns described in U.S. Pat. No. 6,452,462, it is possible to construct an array of slot antennas in a slim flat pack version, in which the thickness of the flat pack is between one and a half and two inches in the example mentioned above. This means that the array can be embedded into the sidewall of a vessel's deck house, the side of a turret, or into any upstanding vessel wall. An antenna thus constructed can also be made as part of a building structure such as the wall of a building. Note that in either case are there unsightly and fragile dish antennas.

In summary, a cavity-backed wideband slimline flat panel antenna array for providing a steerable beam or multiple beam includes an array of slot antennas, each of which fed by its own individual dipole radiator, with the wide bandwidth being due to the matching impedances of the slot antenna and dipole radiator across the entire frequency band. In one embodiment, an upstanding printed circuit balun feed is connected to each dipole. The dipole elements are located to either side of a slot and are arrayed on the underneath side of a dielectric layer under the substrate into which the slots are formed, with the dipole elements directly fed by individual upstanding printed circuit baluns, as one of the many balanced feed approaches, which are arrayed beneath the individual slots antennas. The use of the dipole elements, in addition to providing a wider operational bandwidth also permits feeding each of the slots without having to use striplines which would have to cross each other in an array configuration and therefore not possible to work. A wide bandwidth steerable flat panel array utilizing the dipole fed slot antennas may be mounted on the deck house or other flat structural component of a vessel so as to perform a "smart skin" function in which the antenna not only functions as a radiating element, but also as a structural part of the vessel itself. In commercial applications, the flat panel array may be incorporated into the wall of a building such that point-to-point communications between buildings may be accomplished through an antenna which is also a structural part of the building. Note that the beams from the antenna are aimable by appropriately phasing the array to point at a receiving antenna on an adjacent building.

BRIEF DESCRIPTION OF THE DRAWINGS

These and other features of the subject invention will be better understood with connection with the Detailed Description in conjunction with the Drawings, of which.

DETAILED DESCRIPTION

Figure 1:
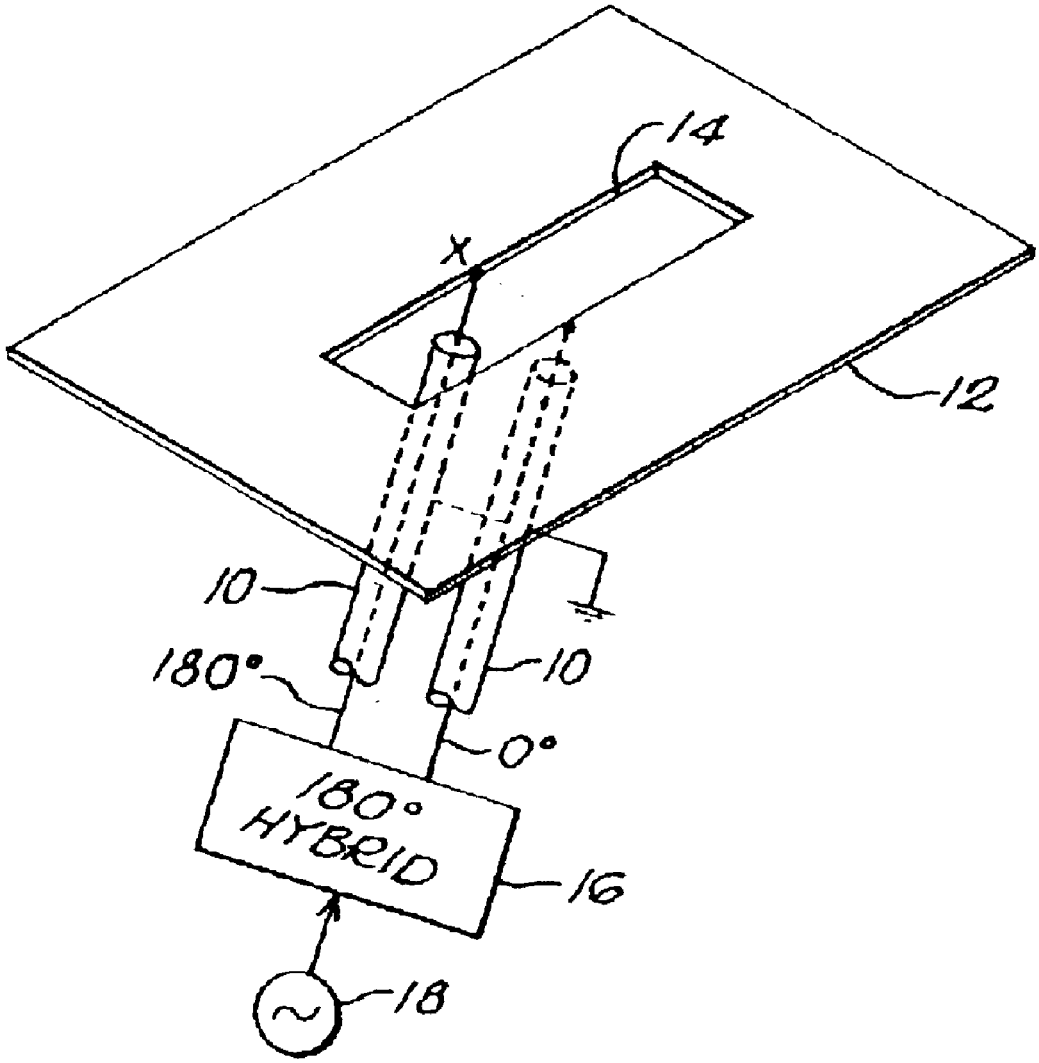
FIG. 1 (PRIOR ART)
FIG. 1 is a diagrammatic illustration of a prior art feed for a slot antenna in which a balanced feed is applied directly to either side of the slot through the utilization of a pair of coaxial cables coupled to a 180-degree hybrid circuit.

Referring now to FIG. 1, in the prior art, a pair of coaxial cables 10 which form a twin-coaxial-lead balun has been utilized to feed a cavity-backed slot antenna 12 having a slot 14 therein. The twin-coaxial-lead balun is shown as being directly connected to the radiating slot either by soldering if the slot is made of a circuit card, or by a screwing approach if the slot is made of metallic sheet.

Here the balun includes a 180-degree hybrid 16 fed by a signal source 18, in which the signals from the hybrid are 180 degrees out of phase. This means that the voltages applied to ether side of slot 14 are equal in magnitude and opposite in phase.

The problem with such a traditional slot antenna is that the percentage bandwidth is only approximately 10 percent. At a 100 MHz center frequency, the operating frequency range would be 100 MHz plus or minus 5 MHz, such that the traditional slot antenna is indeed narrow banded.

Figure 2:
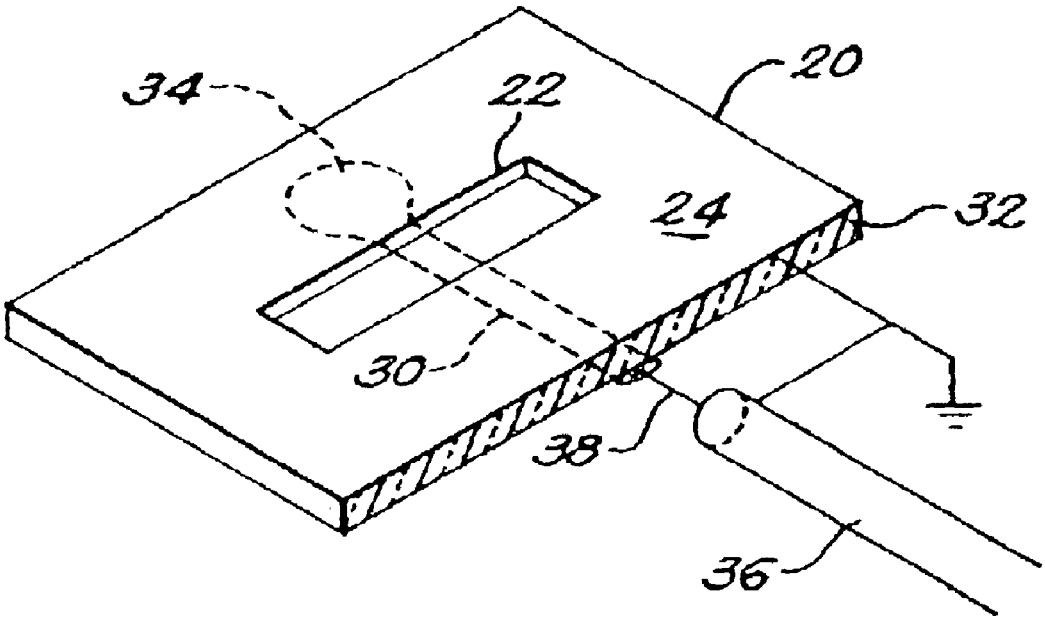
FIG. 2 (PRIOR ART)
FIG. 2 is a diagrammatic illustration of a prior art feed utilizing a quarter wavelength radial stub stripline, in which the stripline is patterned on the underside of a dielectric layer and is positioned transverse to and underneath the associated slot.

Referring now to FIG. 2, in another prior art slotted antenna configuration a cavity-backed slot antenna 20 is illustrated as having a slot 22 in a conductive layer 24, with the antenna being fed by an open circuit stripline shown in dotted outline 30 which is on the underneath side of a dielectric layer 32. This open circuit stripline has a ¼ wavelength radial stub 34 which provides wideband terminations. This increases the percent bandwidth to 25% such that for instance an antenna tuned to 100 MHz will have a frequency range of 100 MHz plus or minus 12.5 MHz.

While this configuration does in fact markedly improve the bandwidth of the slot antenna, when one attempts to array these slots, the feeding of the slots is precluded by the cross over of the striplines.

Thus with the stripline coupled slot antennas, it is only with difficultly that these antennas can be arrayed.

It will be appreciated that these antennas are fed in an unbalanced fashion in which a coaxial cable 36 has a center conductor 38 coupled to stripline 30, with its outer braid coupled to ground and to conductive plate 24 as illustrated.

The problem then becomes how to provide a wide bandwidth slot antenna array. It is a finding of the subject invention that such a wide bandwidth slotted antenna array can be achieved through the utilization of a dipole radiator feed for each of the slots in the array. This finding arose from a mistake in which the solder connections at the end of a balanced line did not actually make electrical contact with the sides of the slot. Measurements taken resulted in an unexpectedly wideband response. This in turn resulted in the design of a dipole radiator to feed the slot which will be described in FIG. 3.

Figure 3:
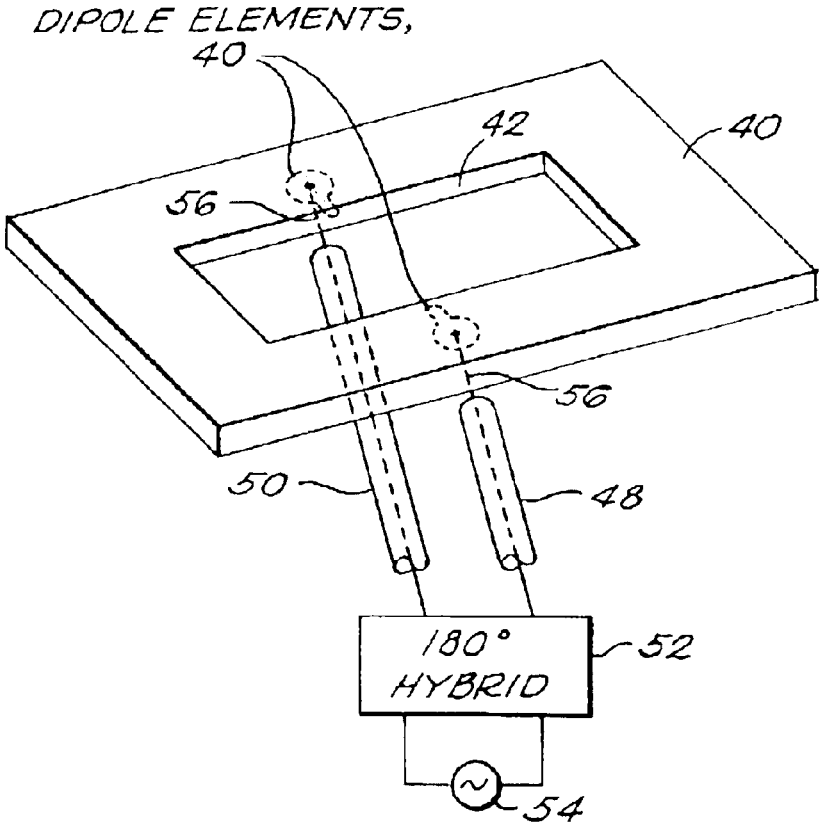
FIG. 3, is a diagrammatic illustration of the subject invention in which a slot antenna is fed by a dipole radiator comprised of two dipole elements or pads, on the underneath side of a dielectric layer, in which the dipole elements are positioned to either side of the slot at a central portion thereof, with the dipole elements then being fed by balanced line coupled to a 180 degree hybrid circuit.

Referring now to FIG. 3, the subject invention includes a slotted antenna 40 having a rectilinear slot 42 which is fed from the underneath side of a dielectric layer 44 by dipole elements 46 shown in dotted outline.

These dipole elements are in the form of a tear drop shaped stripline conductor, with the points of the tear drops running towards each of the sides of the slots as illustrated.

Dipole elements 46 are fed in a balanced fashion by a pair of coaxial cables 48 and 50 which are coupled to a 180-degree hybrid circuit 52 coupled to a signal source 54. The center conductors 56 are directly connected to the dipole elements on the underneath side of layer 44, with the energy being coupled from the dipole elements forming the dipole radiator to the slot antenna. The result, as will be seen, is a very wide bandwidth characteristic for each of the slot antenna elements of the array. This is because as illustrated in FIG. 4 the slot antenna impedance matches the dipole radiator impedance across the band of interest.

Figure 4:
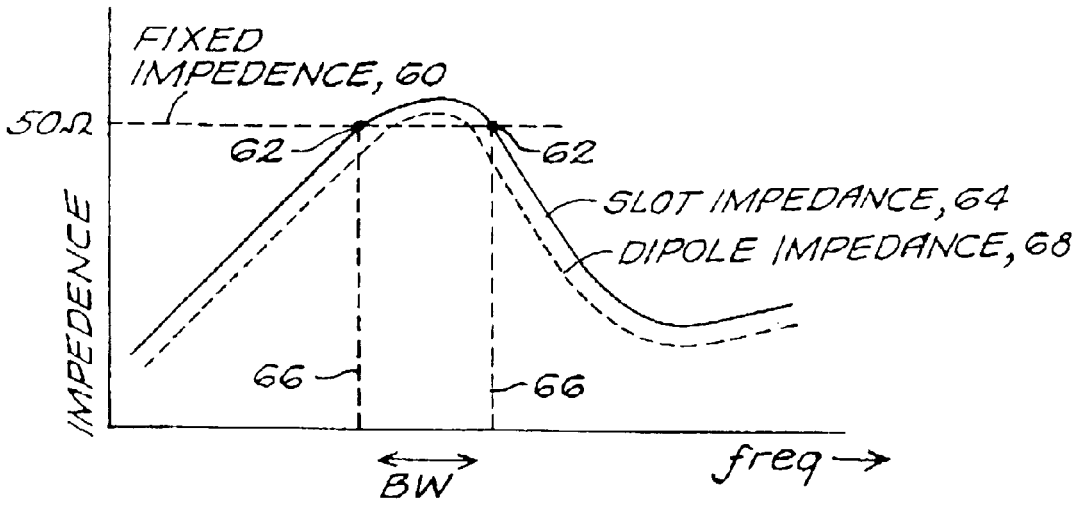
FIG. 4 is a graph illustrating slot and dipole real impedance as a function of frequency, showing the matched real impedance characteristics, thus to give the slot antenna an exceedingly wide operational bandwidth.

It will be appreciated from inspection of FIG. 4 that the two real impedances vary with frequency. If the slot antenna was looking into a fixed impedance such as illustrated at 60, then the point of intersection of this fixed impedance 62 with the slot real impedance curve 64 indicates a relatively narrow bandwidth such as illustrated by dotted lines 66.

However, with the dipole antenna real impedance curve 68 matching the slot antenna Real impedance curve 66, then the bandwidth of the antenna is increased to a 70% bandwidth. This means that for a 100 MHz center frequency for the antenna, the frequency range is 100 MHz plus or minus 35 MHz.

Figure 5:
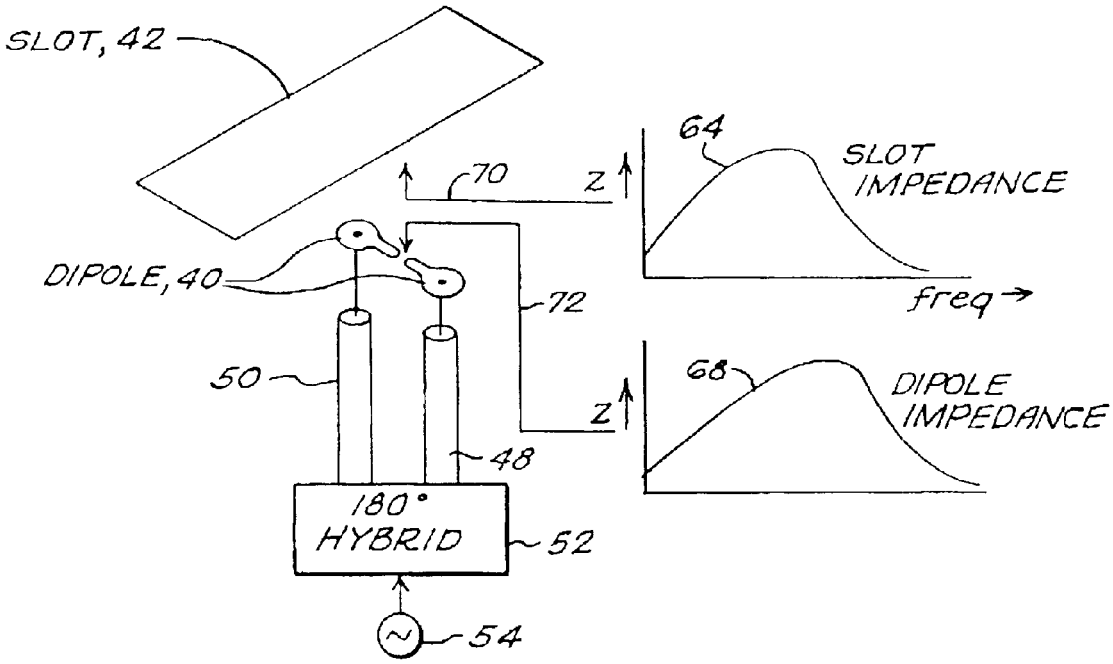
FIG. 5 is a diagrammatic illustration of the subject antenna illustrating the real impedance looking into the slot and into the transmission line illustrating the correspondence of the slot real impedance to the dipole real impedance.

More specifically and referring now to FIG. 5, from a diagrammatic point of view, slot 42 is above dipole elements 46 which are fed via coaxial cables 48 and 52.

As before, cables 48 and 50 are coupled to hybrid 52 and then to signal source 54. Looking into slot 42 as illustrated by arrow 70, the slot real impedance is as illustrated at 64. Looking into the transmission line as illustrated by arrow 72 the dipole real impedance is as illustrated at 68. Since these real impedances match over frequency, the bandwidth of the antenna is as wide as possible.

Figure 6:
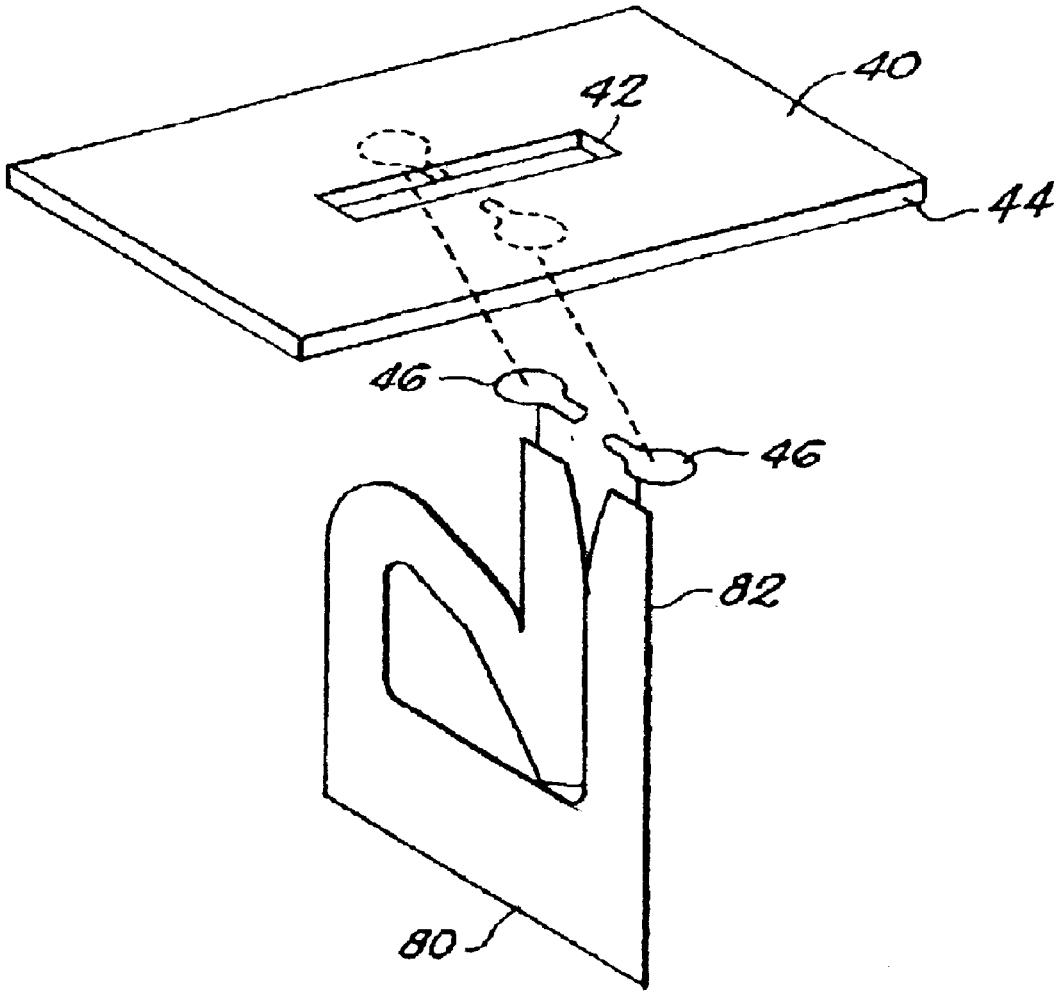
FIG. 6 is a diagrammatic and exploded view of a printed circuit balun utilized to feed the dipole elements which in turn feed the slot antenna.

Referring now to FIG. 6, while any means may be utilized to provide a balance feed for the dipole elements, in this figure a printed circuit balun 80 is illustrated as having two legs 82 and 84 directly coupled to respective dipole elements 46. The printed circuit balun exists on the underneath side of dielectric layers 44. Note that the dipole elements lie adjacent slot 42 at the central region thereof as illustrated. This particular printed circuit balun coil is that which is described in the aforementioned U.S. Patent.

Figure 7:
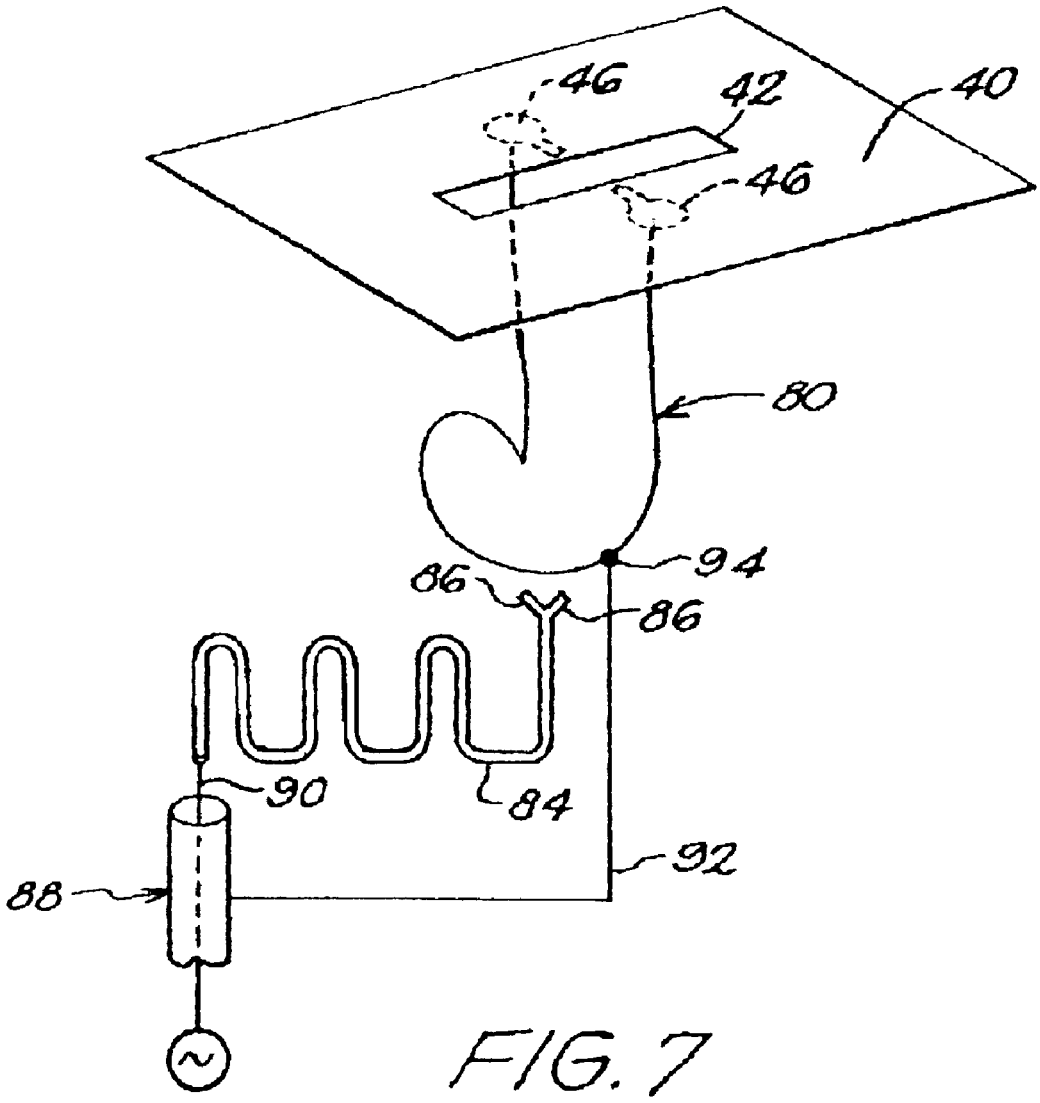
FIG. 7 is a diagrammatic illustration of the feeding of the printed circuit balun in which the balun feed does not deleteriously affect the wide bandwidth achievable by using the dipole radiator feed.

Referring to FIG. 7, the arrangement in FIG. 6 is schematically shown in which balun 80 is fed by a serpentine stripline 84 which lies underneath a portion 86 of the balun. The stripline 84 is terminated by a Y-shaped end portion 86 which assures the matching of coaxial cable 88 impedance to balun 80. Here the central conductor 90 of coaxial cable 88 is coupled to one end of the serpentine stripline feeding the balun, whereas the shield or ground of cable 88 as illustrated at 92 is directly coupled to the portion 94 of balun 80 indicated.

Figure 8:
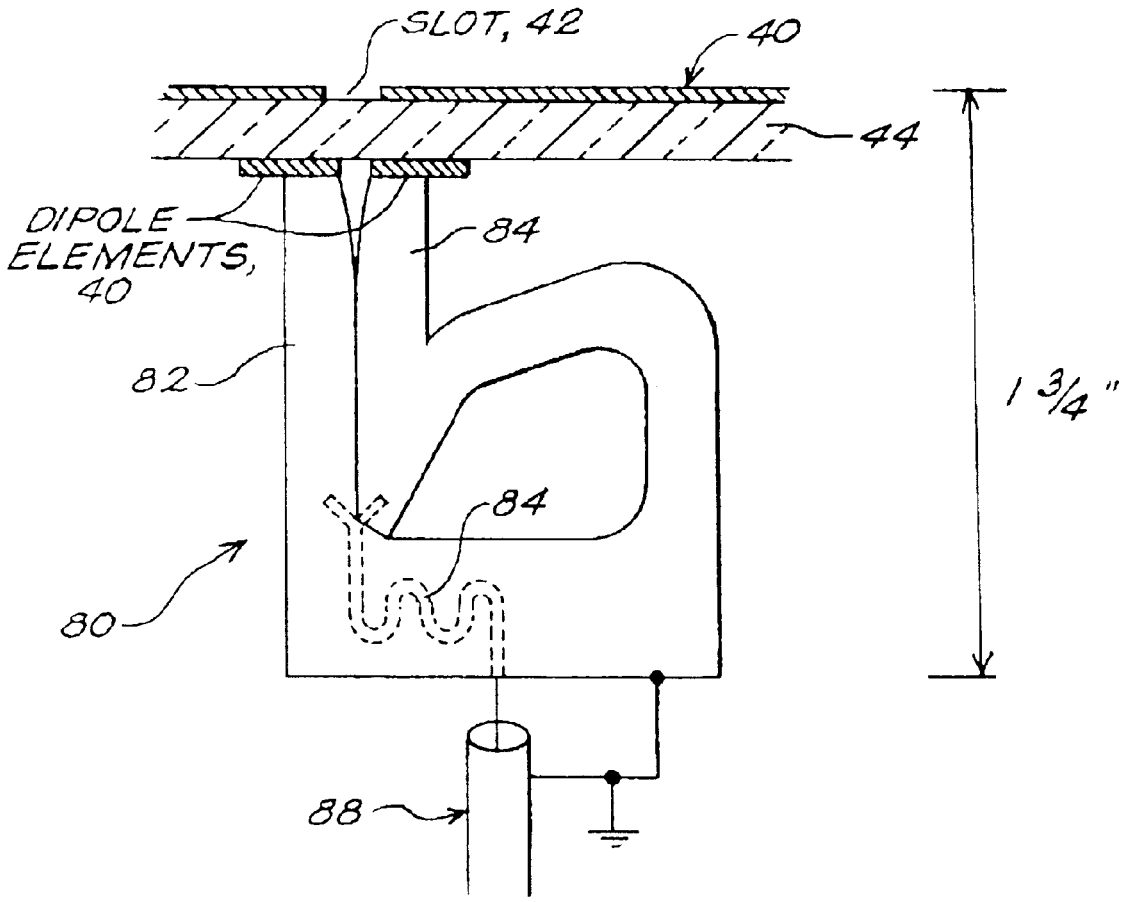
FIG. 8 is a side and cross sectional view of the slot antenna and dipole elements fed by the printed circuit balun of FIGS. 6 and 7.

Balun 80 is illustrated in FIG. 8 showing the connection of legs 82 and 84 to respective dipole elements 46 carried on the underneath side of dielectric layer 44 of slot antenna 40 having slot 42 formed in an electrically conductive layer as illustrated.

The purpose of this illustration is to indicate that the plane of the printed circuit balun is perpendicular to the plane of the slot antenna. These individual baluns are mounted underneath the array of slot antennas such that for each slot antenna there is a corresponding balun feed. Since the balun feeds are sufficiently small, they may be arranged underneath the slotted antenna array so that they do not overlie one another and thus prevent the formation of the array.

Rather the dipole feed for each of the slot antennas permits point feeding underneath each of the slotted antennas such that no overlapping or overlying striplines need be utilized in feeding the slot antennas as was the case for the stripline fed antennas in FIG. 2.

Figure 9:
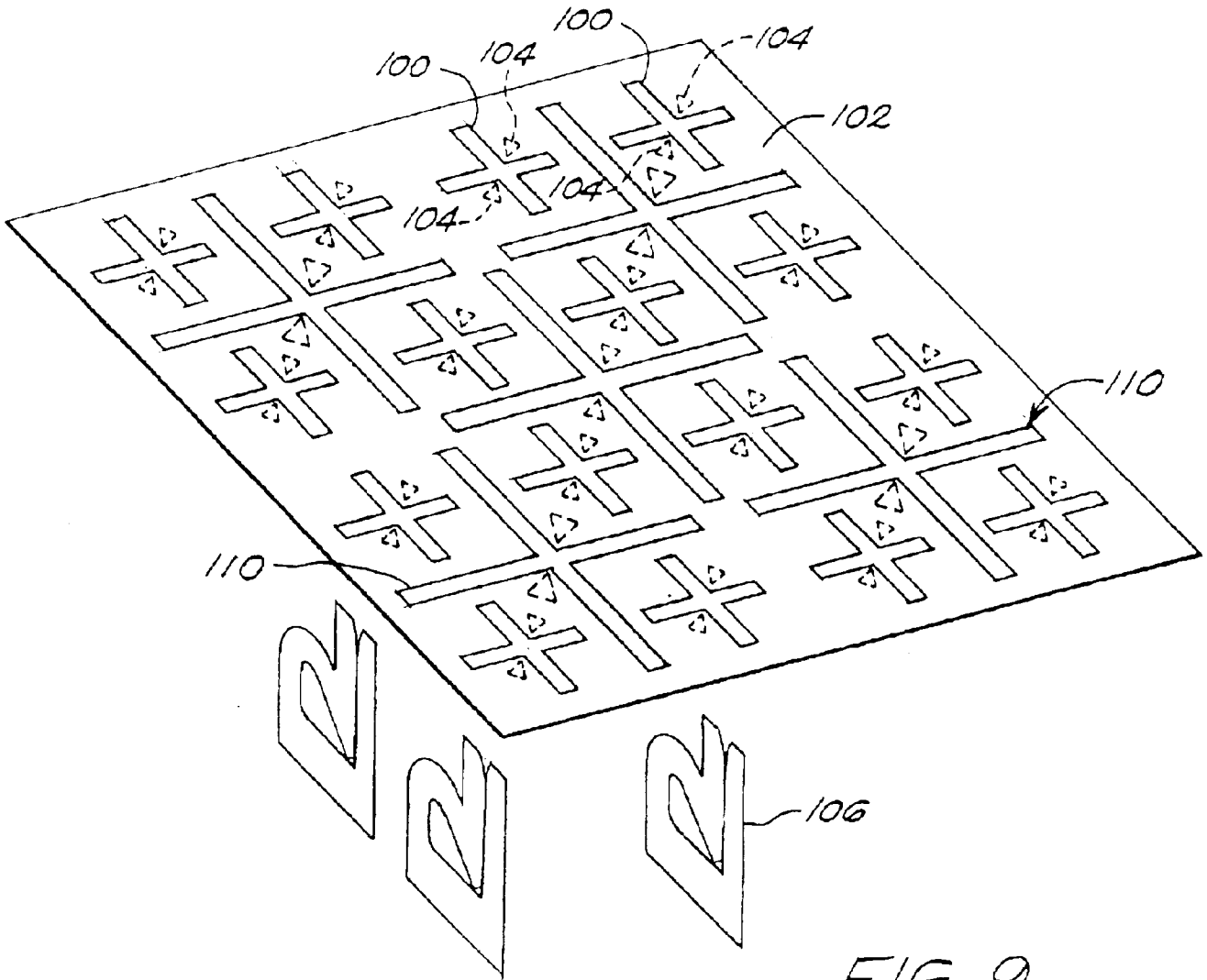
FIG. 9 is a diagrammatic illustration of an array of crossed slot antennas in a conductive substrate illustrating the placement of the associated dipole radiators as well as the interleaving of a lower frequency array of cross slot antennas with a higher frequency array of crossed slot antennas, with both arrays being formed in the same conductive sheet or layer; and, FIG. 10 is a exploded view of the construction of the multiple frequency antenna array of FIG. 9 illustrating the crossed slot antennas and the corresponding number of printed circuit baluns which are upstanding from the bottom cavity of the antenna, thus to connect the array elements to respective baluns.

Referring now to FIG. 9, an array of crossed slot antennas 100 are patterned into a conductive sheet of layer 102, with the dipole feeds 104 for each of those antennas being placed at or adjacent to the center of the crossed slot. Each of these cross slot antennas is fed by its individual balun 106, with the size of the crossed slots in one case corresponding to for instance a of 100–200 MHz band.

In order to increase the over all bandwidth of the antenna, lower frequency crossed slots 110 may be interleaved with the array of smaller crossed slots. Because the frequencies do not overlap there is very little coupling between the two sets of antennas so that they can co-exist on the same conductive layer without interference. The combined antenna can for instance have a frequency range of 100–400 MHz, with each of the slot antennas being provided with an exceptionally wide operational bandwidth.

As a result, not only is the wideband characteristic of the antenna array made possible through the utilization of dipole feed apparatus, the use of the dipole feed elements along with connecting the balun directly beneath each of the dipole feed elements results in the ability to produce an array which does not have cross striplines or any other type of impeding apparatus.

Thus the antenna array of FIG. 9 includes a high frequency array and a low frequency array, with the arrays co-existing in the same conductive sheet or layer.

Figure 10:
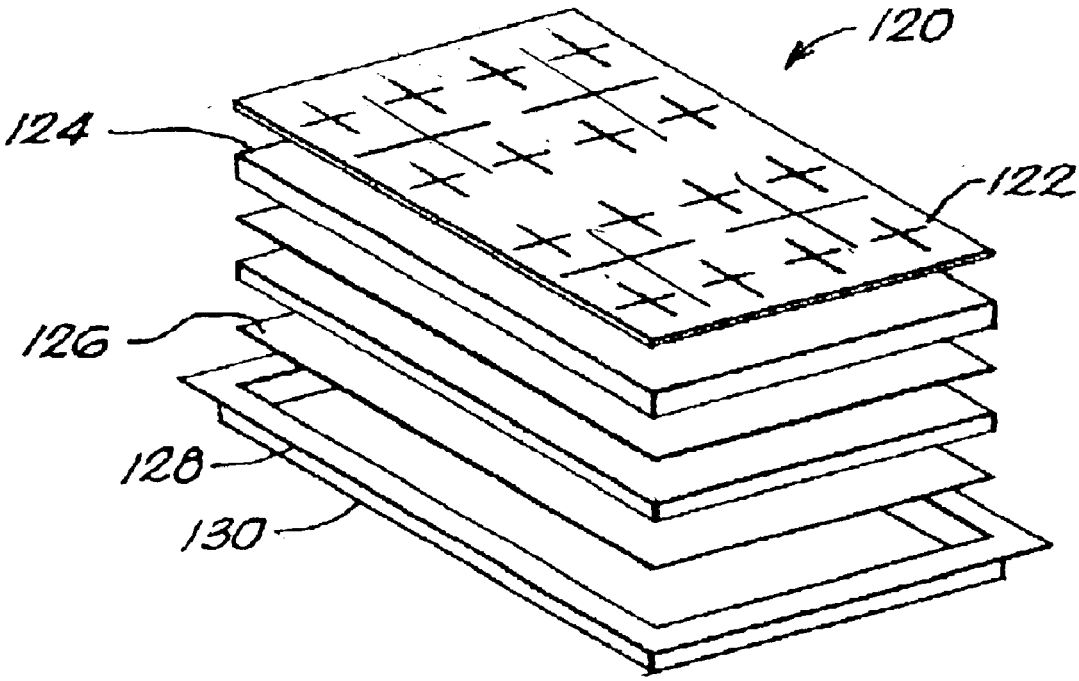

How this antenna array is constructed is illustrated in FIG. 10 in which like elements contain like reference characters.

Referring now to FIG. 10, the combined array 120 includes slotted antennas having slots within a conductive slotted layer 122. Slotted layer 122 is superimposed over a dipole feed layer 124. A spacer layer 126 is superimposed over a number of printed circuit baluns 128 which are mounted to a cavity-backing cover or plate 130 which serves to back the array.

Each of the slotted antennas has a 2:1 bandwidth slot. When these antennas are arrayed one can extend the bandwidth slot to a 4:1 bandwidth and even to an 8:1 bandwidth by using different length slots. The 2:1 ratio is a good ratio which basically allows one to put higher frequency bandwidth antennas somewhere in the middle of the lower bandwidth antenna array, with this interleaving permitting an overall antenna of greater bandwidth.

As such, the subject dipole fed method and apparatus solves a long term problem of a lack of instantaneous operating frequency bandwidth for planar cavity-backed slot antennas. The planar cavity-backed slot antennas are used most often in low radar, cross section applications. By utilizing the dipole fed method for cavity-backed antennas, the instantaneous operating frequency bandwidth can be extended to 2:1 or a 66% frequency bandwidth. This is a two-fold frequency bandwidth improvement. In addition, the use of the planar single cavity-backed slot antenna design can be extended into even wider instantaneous frequency bandwidth by log periodically arranging a group of single slots. The subject invention thus also enables a multi-band antenna array capability by properly arranging the array slot elements, since each slot element can provide a 2:1 instantaneous frequency bandwidth.

In other words, the slot operating in the twice the frequency band (2F–4F, 2:1 frequency bandwidth) can be inserted between the lower band slots (F, 2F, 2:1 frequency bandwidth). Since the 2:1 is a natural geometric ratio an ultra wide frequency band antenna can be achieved by adding more bands of elements in a given aperture. Thus the achievable instantaneous bandwidth for stripline antennas being generally less than 1.3:1 or 25% frequency bandwidth has now been exceeded through the matching of the impedances associated with the dipole antennas to that of the slotted antennas.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. A wideband cavity-backed slot antenna comprising:

a conductive layer having a slot patterned into said conductive layer;

a dielectric layer underneath said conductive layer;

a pair of dipole elements patterned on the underneath side of said dielectric layer in spaced adjacency to opposite positions of said slot: and, a balun circuit connected to said dipole elements for feeding said slot antenna.

2. The antenna of claim 1, wherein said dipole elements are tear drop shaped.

3. The antenna of claim 1, wherein said balun circuit includes a printed circuited balun patterned onto a planar substrate, the plane of said substrate being perpendicular to the plane of said conductive layer.

4. A method for fabricating a wideband cavity-backed slotted antenna array comprising the steps of:

forming an array of slotted antennas in a conductive layer;

providing a dielectric layer underneath the conductive layer;

patterning a series of pairs of dipole elements on the underneath side of the dielectric layer such that each of the slots has an associated pair of dipole elements; and, feeding each of the pairs of dipole elements with a balanced input.

5. The method of claim 4, wherein the balanced input is generated by a balun.

6. The method of claim 5, wherein the balun is patterned onto a substrate that is perpendicular to the plane of the conductive layer, the balun having two legs, each leg connected to a different one of the pair of dipole elements.

7. The method of claim 4, and further including the step of providing two sets of slotted antennas in the conductive layer, the sets having different non-overlapping frequency ranges.

* * * * *